United States Patent [19]

Nelson et al.

[11] Patent Number: 4,784,757

[45] Date of Patent: Nov. 15, 1988

[54] SOLID MATERIAL SEPARATOR

[76] Inventors: Edgar E. Nelson, Rt. 9, Box 24, Caldwell, Id. 83605; Lonnie D. McClung, 48304 Garbo, Indio, Calif. 92201

[21] Appl. No.: 72,650

[22] Filed: Jul. 13, 1987

[51] Int. Cl.[4] ..... B03B 5/00

[52] U.S. Cl. ..... 209/159; 209/2

[58] Field of Search ..... 209/158, 2

[56] References Cited

U.S. PATENT DOCUMENTS

| | | | |
|---|---|---|---|
| 69,784 | 10/1867 | DuVall | 209/158 |
| 618,270 | 1/1899 | Jackson | 209/158 |
| 636,675 | 11/1899 | Latimer | 209/153 |
| 1,729,545 | 9/1929 | Marchant | 209/158 |
| 1,959,212 | 5/1934 | Miller | 209/158 |
| 1,966,001 | 7/1934 | Borke | 209/158 |
| 2,426,839 | 9/1947 | Morris | 209/158 |
| 3,075,643 | 1/1963 | Dolanchanal | 209/158 |
| 3,288,975 | 10/1966 | Evans | 209/158 |
| 3,295,677 | 1/1967 | Condolios | 209/158 |
| 3,312,341 | 4/1967 | Weinecke et al. | 209/158 |
| 4,101,419 | 7/1978 | Bergman | 209/166 |
| 4,715,949 | 12/1987 | Watts | 209/158 |

FOREIGN PATENT DOCUMENTS

| | | | |
|---|---|---|---|
| 216016 | 6/1956 | Australia | 209/158 |
| 492106 | 6/1919 | France | 209/158 |
| 210663 | 2/1924 | United Kingdom | 209/158 |

*Primary Examiner*—William L. Freeh

*Attorney, Agent, or Firm*—Paul F. Horton

[57] ABSTRACT

Apparatus for the separation of solid materials of different specific gravities comprising a vertical separator tube having a material inlet port, a light material discharge port located above the inlet port, and a heavy material discharge port located below the inlet port; a holding tank having a top opening for receiving the solid materials to be separated and a bottom opening connected to the inlet port of the separator tube by a feeder tube; a pressurized water source, as by a pump; and a conduit connecting the water source to the separator tube at or below the heavy material discharge port. The holding tank is located at such a height as to allow water coming into the tank from the separator tube to reach a predetermined static level within the tank. The heavy material discharge port is located substantially below the water static level in the tank and adjacent the pressurized water intake so that heavy material may be rapidly removed by water moving at a high velocity.

13 Claims, 1 Drawing Sheet

15
33
3
L
4
30
10
28
27
V
25
35
20
23
55
B
22

26
29
40
47
50
42
P
45
74
79
72
78
77
70

SOLID MATERIAL SEPARATOR

BACKGROUND OF THE INVENTION

1. Field of the Invention

This invention relates, in general, to solid material separators, and, more particularly to gravity separators which utilize a high velocity water flow to remove heavy materials and which utilize a static water level to control flow discharge of light materials.

2. Description of the Prior Art

With present day methods of placer mining, raw materials containing silt, vegetation, clay, dirt, sand, gravel, rock, gold, and other substances are taken from the ground and washed and tumbled down a gold retrieving device, such as a sluice box, with large volumes of water. The water used for such mining is usually taken from rivers or creeks and the water returned to the rivers and creeks. Under current methods of mining, the water being returned to the rivers and streams has a severe detrimental impact upon the environment in that the water is returned in a cloudy, muddy, silt suspended condition. While there is presently an attempt to utilize settling ponds, this is impractical because of the size of pond required for the vast volumes of water used and because some of the contaminants continue to remain suspended even after months of settling.

Separators known in the art, as typified by U.S. Pat. No. 2,533,655 issued to G. L. Wilmot and U.S. Pat. No. 4,012,316, issued to S. E. Ostlund et al, are impractical because of their complexity; because of their lack of capability to provide rapid discharge of heavy materials by a high velocity water jet; and because of lack of control over water-light material discharge ratio.

SUMMARY OF THE INVENTION

The present invention provides for the rapid discharge of heavy materials by a high velocity jet stream while providing removal of light weight sediments with a minimum of water by utilizing a vertically oriented separator tube which has a heavy material discharge port which empties into and is in fluid communication with a high velocity water conduit and which has a light material discharge port, the flow through of which is controlled by a static water level in a connected holding tank. A more definite description may be found in the appended claims.

A general object of the present invention is, therefore, to provide a solid material separator which has a minimum of moving parts, which is readily portable, and which removes light weight contaminates from pit material so that water used to separate heavy materials may be returned to rivers, streams and holding ponds in a clear, substantially uncontaminated condition.

It is a primary object of the present invention to provide a solid material separator which includes a holding tank for transporting materials to a tube separator and which maintains a constant controlled pressure head at the light material discharge port or ports by means of a substantially static water level within the holding tank.

It is also a primary object of the present invention to provide a solid material separator which utilizes a high velocity water jet for removing heavy materials from the separator.

Additional objects and advantages will become apparent and a more thorough and comprehensive understanding may be had from the following description taken in conjunction with the accompanying drawings forming a part of this specification.

DETAILED DESCRIPTION OF THE INVENTION

Figures 1, 2:
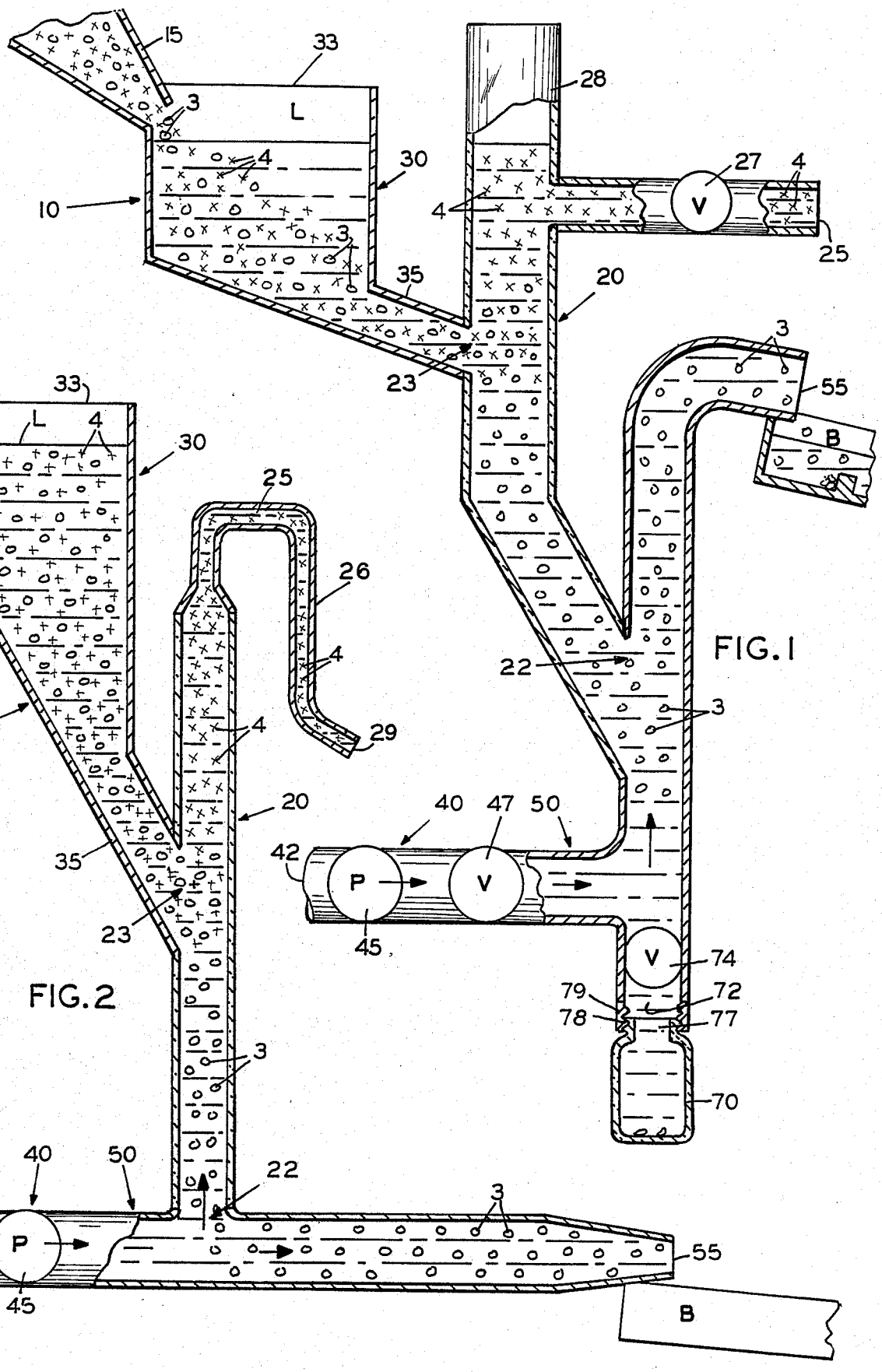
FIG. 1 is a view, in partial section, of one preferred embodiment of the separator apparatus of the present invention, showing material flow.
FIG. 2 is a view, in partial section, of a second preferred embodiment of the separator apparatus of the present invention, also showing material flow.

Referring now to FIG. 1, one preferred embodiment of solid material separating apparatus 10, made according to the present invention, is disclosed. Separating apparatus 10 includes a separation tube 20; a holding tank 30; pressurized water means 40; and a water conduit 50.

Separator tube 20 is vertically oriented and includes a material inlet port 23 for receiving solid material from holding tank 30 through feeder tube 35. Located above inlet port 23 are one or more light material discharge ports, only one port 25 being shown. Located below the inlet port are one or more heavy material discharge ports 22. The separator tube, while preferably being constructed of high impact, transparent, thermoplastic material so that material flow may be observed for closer control, may be constructed of any suitable material.

Holding tank 30 is provided with a top opening 33 for receiving the solid materials to be separated and includes a bottom opening for feeding solid materials to the separator tube by means of the feeder tube. The holding tank is in fluid communication with the separator tube so that the material can enter the separation tube through substantially static water into the smooth ascent of the water in the separation tube and so that selected and controlled pressure head may be obtained on the light material dishcarge port 25, as determined by the static water level L within the tank. The rate of flow of ascending water in tube 20 can be adjusted by control valve 27 as the characteristics of the material to be separated may change from time to time. A hopper 15 may be used for transporting solid materials to the tank from a conveyor, loader, or the like, not shown.

Pressurized water means 40 may be obtained from a stand pipe or other raised water source, but it is contemplated that a pump 45 will he used for creating the pressure. Water entering inlet conduit 42 is pressurized by the pump and enters conduit 50 where, optionally, pressure and flow velocity may be controlled as by a conventional valve 47. Water flows at a high velocity through conduit 50 and out discharge port 55 of the conduit so as to rapidly transport all heavy materials out of the apparatus and onto a sluice box B, for example. The water also flows upwardly through the separator 20 until a predetermined level is reached within stand pipe 28 of the separator and in holding tank 30, with water also flowing out of light material discharge port 25 of the separator tube. A valve 27, optionally may be used to control flow through the discharge port; the level of the water in the stand pipe and the holding tank being determined by the pressure of water entering the system from the pump and the rate of discharge through ports 55 and 25.

Solid material, such as pit run material, including heavy material sand, gravel, rock, and gold, designated by the circles 3 and light material silt, vegetation, particulate clay, light sand, and the like, designated by the X designs 4, is fed into hopper 15 and may be screened to incorporate material having a specific maximum size. Once entering the holding tank, the solid material is transferred through feeder tube 35 into the separator tube. Once entering the upward flow of water in separator tube 20, the heavy material continues to descend until it enters conduit 50 where the material is propelled out of the system by the high velocity stream in conduit 50. Extremely heavy material of appreciable size, such as gold nuggets, may be collected in a sample container 70 through a port 72 which is preferably provided with a shut-off valve 74 so that the container may be removed for emptying while the apparatus is in operation. The container includes a threaded mouth portion 77 which threadably engages mating threads 78 of collar 79 which is affixed to the lowermost end of pressurized conduit 50 about port 72, for ready removal. The container is preferably made of transparent material so that the contents of the container may be viewed, without removal. Sluice box B, not a part of this invention, may then be used to extract fine gold from other heavy material and the clear water is returned to the stream or river. Meanwhile, the light material such as silt, clay particulate, mud, light sand, and the like is floated upward and out of port 25 by the water flow. In that the water flow is low, ie., the light material-water ratio is high, only small settling ponds are required, or, in the alternative, the silt may be sprayed over the mined area.

Referring now to FIG. 2, a second embodiment of the invention is shown. Like numerals refer to like structure of the first embodiment shown in FIG. 1. In the second embodiment, conduit 50 extends laterally along the bottom of the apparatus without bend or curve in the conduit and the heavy materials fall into the conduit, against the upward flow of water in the separator tube, and are propelled out of port 55 with considerable force and rapidity. The second embodiment does not include the stand pipe, but rather flow may be determined by the level of port 29 of conduit 26 attached to the separator tube at discharge port 25.

As an example of usage of the device shown in FIG. 2, the apparatus was constructed utilizing a one and three-quarter inch diameter discharge port 55 on conduit 50 and a three-quarter inch diameter discharge port 29 on conduit 26. With a water level in tank 30 five feet above heavy material discharge port 55 and two feet above light material discharge port 29, flow rate from port 55 was 133.97 gallon per minute and flow rate from port 29 was 15.56 gallon per minute. It will therefore be seen that approximately 90% of the water flow may be returned in a substantially silt free condition to the river or stream and only about 10% of the water is used to remove the silt and other light weight contaminants, thereby greatly decreasing the number and size of settling ponds required or eliminating them altogether.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. Apparatus for the separation of mineral ores of differing specific gravity comprising:

a vertically oriented separation tube, said separation tube provided with an unobstructed solid material inlet port; one or more light material discharge ports located above said inlet port; a stand pipe at its uppermost end, said stand pipe extending above the uppermost discharge port; and one or more unobstructed heavy material discharge ports located below said inlet port for rapidly removing heavy material by means of a high velocity stream of water;

pressurized water means;

a pressurized water conduit connected to said pressurized wate means and connected to and in fluid communication with said separation tube below said material inlet port; and a holding tank having a top opening for introduction of solid materials and a bottom opening in unobstructed fluid communication with said solid material inlet port of said separator tube for transfer of solid material to said separator tube by gravity from said holding tank and transferring water from said separator tube to said holding tank, said top opening of said holding tank located above the top light material discharge port of said separator tube for maintaining a water level in said tank above said light material discharge port.

2. The apparatus as described in claim 1 wherein said pressurized water conduit is connected to said separator tube at or below the lowermost discharge port of said separator tube.

3. The apparatus as described in claim 1 wherein said pressurized water means includes a pump.

4. The apparatus as described in claim 1 further comprising a water inlet valve in said pressurized water conduit for controlling water flow and head pressure in said apparatus.

5. The apparatus as described in claim 1 wherein said separator tube is constructed of transparent material.

6. The apparatus as described in claim 1 wherein said separation tube is provided with a sample part having a shut-off valve and further comprising sample collection means for receiving material from said sample port.

7. The apparatus as described in claim 6 wherein said sample collection means includes a threaded collar surrounding said lowermost port and a container having a threaded mouth portion for engaging said collar.

8. The apparatus as described in claim 7 wherein said container includes at least one transparent portion for viewing the contents of said container.

9. Apparatus for the separation of mineral ores of differing specific gravity and materials of differing sizes and weights of the same specific gravity comprising:

a vertically oriented separation tube, said separation tube provided with an unobstructed solid material inlet port; a light material discharge port located above said inlet port; a heavy material discharge port located below said inlet port; and a stand pipe at its uppermost end, said stand pipe extending above the uppermost discharge port;

pressurized water means;

a pressurized water conduit connected to said pressurized water means and connected to and in fluid communication with said separation tube below said material inlet port; and a holding tank having a top opening for introduction of solid materials and a bottom opening in unobstructed fluid communication with said solid material inlet port of said separator tube for transfer of solid materials by gravity from a substantially static water level within said holding tank to a smooth ascending flow rate of water in said separation tube, said top opening of said holding tank located above the top light material discharge port of said separator tube for maintaining a substantially static water level in said tank above said light material discharge port.

10. The apparatus as described in claim 9 wherein said pressurized water conduit is connected to said separator tube below the uppermost discharge port of said separator tube.

11. The apparatus as described in claim 9 wherein said separation tube is provided with a sample port having a shut-off valve and further comprising sample collection means for receiving material from said sample port.

12. The apparatus as described in claim 11 wherein said sample collection means includes a threaded collar surrounding said lowermost port and a container having a threaded mouth portion for engaging said collar.

13. The apparatus as described in claim 12 wherein said container includes at least one transparent portion for viewing the contents of said container.

* * * * *